US006390045B1

(12) United States Patent
Mae et al.

(10) Patent No.: US 6,390,045 B1
(45) Date of Patent: May 21, 2002

(54) VARIABLE VALVE TIMING APPARATUS

(75) Inventors: Yousuke Mae; Fumihiko Imamura, both of Yokohama (JP)

(73) Assignee: Nissan Motor Co., Ltd., Kanagawa (JP)

( * ) Notice: Subject to any disclaimer, the term of this patent is extended or adjusted under 35 U.S.C. 154(b) by 0 days.

(21) Appl. No.: 09/933,714

(22) Filed: Aug. 22, 2001

(30) Foreign Application Priority Data

Sep. 25, 2000 (JP) ..... 2000-289976

(51) Int. Cl.[7] ..... F01L 1/34

(52) U.S. Cl. ..... 123/90.17; 123/90.31; 74/568 R; 464/2; 464/160

(58) Field of Search ..... 123/90.15, 90.17, 123/90.31; 74/568 R; 464/1, 2, 160, 161

(56) References Cited

U.S. PATENT DOCUMENTS 4,754,727 A * 7/1988 Hampton ..... 123/90.15
5,031,585 A 7/1991 Muir et al.
5,219,313 A * 6/1993 Danieli ..... 464/2
5,381,764 A * 1/1995 Fukuma et al. ..... 123/90.17
6,328,008 B1 * 12/2001 Io ..... 123/90.17

FOREIGN PATENT DOCUMENTS

JP 4-272411 A 9/1992
JP 10-153105 A 6/1998

* cited by examiner

*Primary Examiner*—Weilun Lo
(74) *Attorney, Agent, or Firm*—Shinjyu Global IP Counselors, LLP

(57) ABSTRACT

A variable valve timing apparatus has a rotational torque transmission path that changes the relative phases of a camshaft that moves an engine valve and a rotary crank body that is coupled to the crankshaft. The rotational torque transmission path has uses an electromagnetic brake delay rotation of a drum, which is coupled to the rotary crank body by a biasing member and a moving member. When rotation of the drum is delayed, the moving member changes the angular orientation between the drum and the rotary crank body against the biasing force of the biasing member. The electromagnetic brake is coupled to a cover by two protrusions and two concavities. The protrusions are arranged to prevent contact between the electromagnetic brake and the drum due to tension of the chain.

20 Claims, 7 Drawing Sheets

VARIABLE VALVE TIMING APPARATUS

BACKGROUND OF THE INVENTION

1. Field of the Invention

The present invention generally relates to an improvement of a variable valve timing apparatus for an internal combustion engine. More specifically, the present invention relates a variable valve timing apparatus that changes the valve timing of the intake and exhaust valves by changing the phase of the camshaft relative to that of the crankshaft.

2. Background Information

Japanese Laid-Open Patent Publications H4-272411 and H10-153105 disclose variable valve timing apparatuses for an internal combustion engine that change the valve timing of the intake and exhaust valves. The variable valve timing apparatuses disclosed by these publications are of a type that uses an electromagnetic brake.

In other words, this type of variable valve timing apparatus has a moving member in a rotational torque transmission path that transmits torque from a rotary crank body to a camshaft. The rotary crank body rotates in sync with a crankshaft. A drum that is coupled to the moving member is biased toward a rotational direction of the camshaft by a biasing means such as a torsional spring. By attracting an axial surface of the drum toward the electromagnetic brake with a magnetic force, the electromagnetic brake is attracted (biased) toward the drum. By delaying rotations of the drum and displacing the moving member in the axial direction, the phase of the camshaft relative to that of the rotary crank body is changed. This electromagnetic brake is housed within a cover that is fixed to the engine main body side while the electromagnetic brake is in a state in which rotation relative to the engine main body is restricted.

There exists a need for an improved variable valve timing apparatus for an internal combustion engine. This invention addresses this need in the prior art as well as other needs, which will become apparent to those skilled in the art from this disclosure.

SUMMARY OF THE INVENTION

It has been discovered that in variable valve timing apparatus using an electromagnetic brake, a stable braking torque cannot be generated unless surfaces of the electromagnetic brake and the drum, which axially oppose each. other, uniformly face and contact each other.

However, during the operation of the system, tension from a timing chain or timing belt is applied to a sprocket or pulley, which is a part of the rotary crank body. Due to this tension, a center axis of the drum that is coupled to the rotary crank body becomes inclined. Accordingly, the surfaces of the electromagnetic brake and the drum that are opposite each other may stop uniformly facing and contacting each other. Moreover, as a result of this inclination of the center axis of the drum, the opposing surfaces of the electromagnetic brake and the drum may partially contact each other. In such case, a desired frictional resistance cannot be obtained. Therefore, the phase adjustment will be Inegatively affected.

Alternatively, a bearing can be provided on an end of the camshaft, such that the electromagnetic brake can be rotatably supported by the camshaft via the bearing. However, the structure becomes very complicated in this case. Accordingly, this arrangement is not desirable from the point of view of cost and layout.

Also, where a certain clearance is secured between the opposing surfaces of the electromagnetic brake and the drum, such that excessive friction will not be generated between the opposing surfaces of the electromagnetic brake and the drum due to inconsistency in size of members, as axial vibrations are inputted into the electromagnetic brake, the electromagnetic brake may vibrate axially or collide into the cover or the drum, causing noises.

Furthermore, as such clearance is enlarged, the amount of power of the electromagnetic brake that is required to attract the drum becomes greater. Accordingly, the electromagnetic brake may need to be larger, power to be consumed may increase, and accordingly the fuel efficiency may be worsened.

Additionally, as such clearance becomes larger, the behavior of the electromagnetic brake becomes unstable during the operation. Accordingly, it is difficult for the electromagnetic brake to attract the surface of the drum with a stable uniform force.

The present invention has been conceived in view of the aforementioned problems. In other words, a variable valve timing apparatus for an internal combustion engine is provided that includes a rotary crank body, a moving member, a drum, a biasing member, an electromagnetic brake, a cover and a rotation regulation mechanism. The rotary crank body is adapted to be coaxially coupled with a camshaft, and to be operatively rotated by a crankshaft. The moving member operatively couples the rotary crank body to the camshaft along a rotational torque transmission path that transmits torque from the rotary crank body to the camshaft. The drum is operatively coupled to the moving member to move the moving member in an axial direction relative to the drum upon relative rotational movement between the drum and the moving member. The biasing member elastically couples the drum to the rotary crank body to bias the drum in a direction of rotation of the camshaft relative to the rotary crank body. The electromagnetic brake is disposed opposite an axial side surface of the drum to attract the axial side surface of the drum towards the electromagnetic brake with a magnetic force upon energizing the electromagnetic brake to delay rotation of the drum about the camshaft and to change a phase of the camshaft relative to a phase of the rotary crank body due to an axial movement of the moving member. The cover is fixed to an engine main body side of the electromagnetic brake to cover the electromagnetic brake. The rotation regulation mechanism is operatively coupled between a wall portion of the electromagnetic brake and a wall portion of the cover to regulate relative rotation of the electromagnetic brake about the camshaft relative to the cover. The rotation regulation mechanism includes first and second protrusions provided on one of the wall portions and first and second concavities provided on the other of the wall portions. The wall portions are arranged to oppose each other with the first and second protrusions being coupled to the first and second concavities, respectively. The first and second protrusions lying on a base line passing substantially through a center of the drum.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
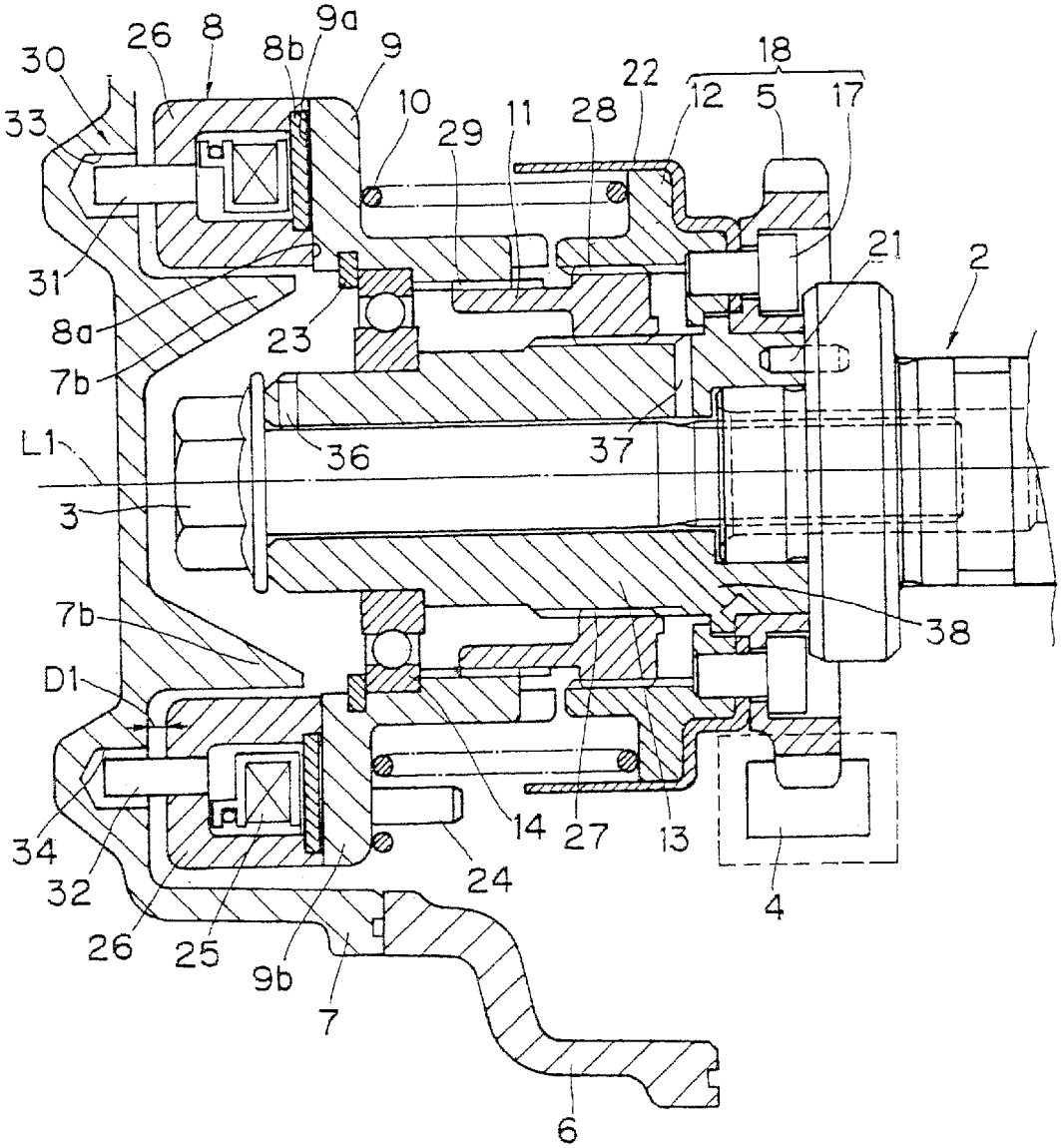
FIG. 1 is a cross sectional view of a variable valve timing apparatus for an internal combustion engine in accordance with one embodiment of the present invention.
Figure 2:
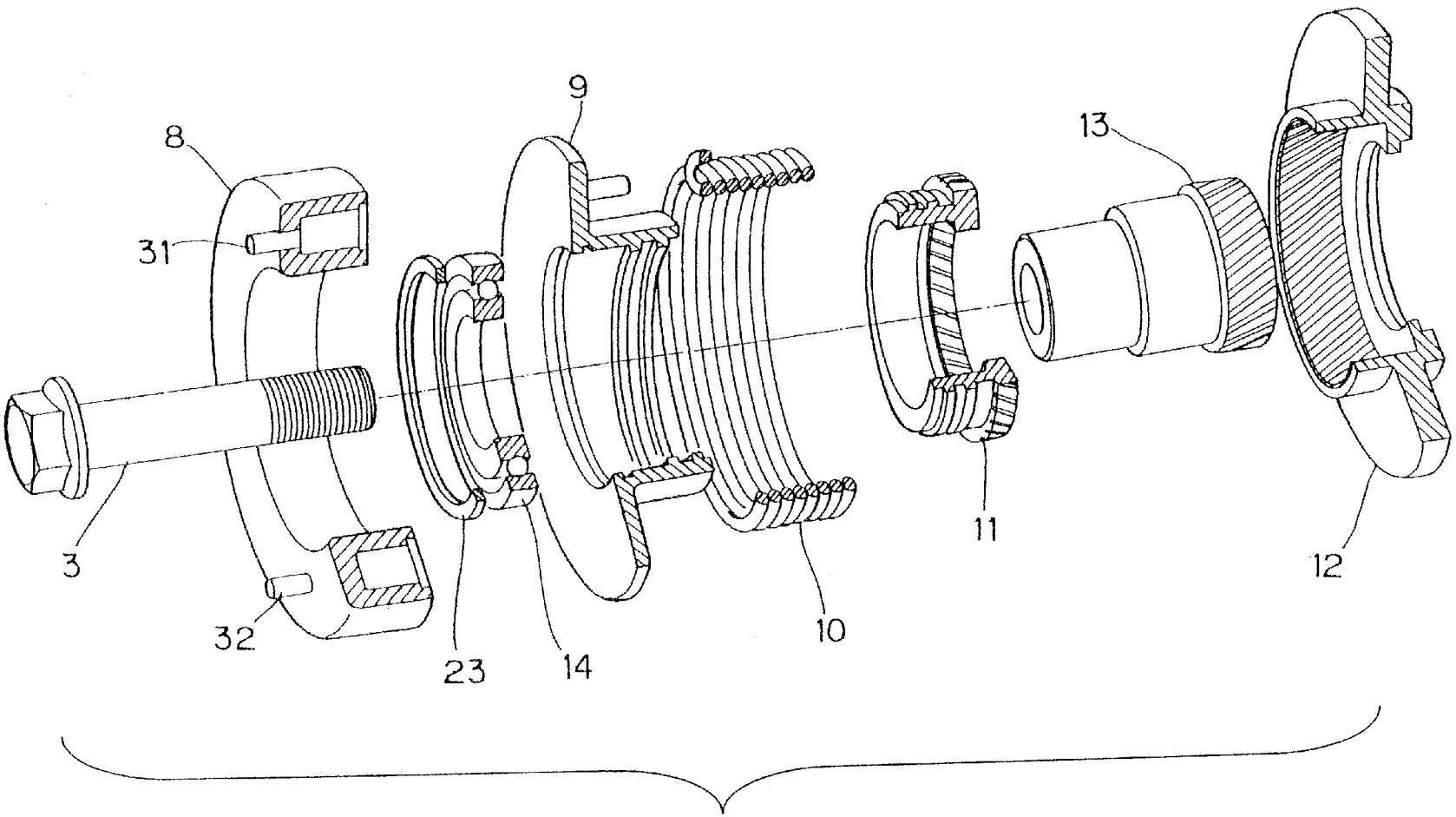
FIG. 2 an exploded perspective view of the variable valve timing apparatus illustrated in FIG. 1, with portions broken away for purposes of illustration.

Referring initially to FIGS. 1 and 2, a variable valve timing apparatus is illustrated to explain a first embodiment of the present invention. The variable valve timing apparatus has a rotational torque transmission path that changes the relative phases of a camshaft 2 that moves a plurality of engine valve (not shown) and a rotary crank body 18 that is coupled to a crankshaft 1 (See FIGS. 3 and 4).

The variable valve timing apparatus is disposed on an end of a camshaft 2. The camshaft 2 drives the intake and/or exhaust valves (not shown) in a conventional manner. The variable valve timing apparatus basically includes a rotary crank body 18, a cover 7, an electromagnetic brake 8, a substantially cylindrical moving member 11, a drum 9, a coil torsion spring 10, a cylindrical splined shaft 13, and a rotation regulation mechanism 30. As disscussed below, the variable valve timing apparatus uses the electromagnetic brake 8 to delay rotation of the drum 9, which is coupled to the rotary crank body 18 by the torsion spring 10 and the moving member 11.

The rotational torque or power transmission path between the rotary crank body 18 and the camshaft 2 is basically formed by the moving member 11, the drum 9, the torsion spring 10, and the splined shaft 13. The rotary crank body 18 rotates in sync with a crankshaft 1 (See FIGS. 3 and 4) during the non-energized state of the electromagnetic brake 8. During the non-energized state of the electromagnetic brake 8, the moving member 11 is disposed on the rotational torque transmission path that directly transmits torque from the rotary crank body 18 to the splined shaft 13 connected to the camshaft 2. The drum 9 engages an axial side (left hand side in FIG. 1) of the moving member 11. The coil torsion spring 10 functions as a biasing means that biases the drum 9 in the direction of rotation of the camshaft 2 relative to the rotary crank body 18. The electromagnetic brake 8 is disposed opposite an outer axial side surface 9*a* (left hand side in FIG. 1) of the drum 9. The cover 7 is fixedly coupled to a sprocket cover 6 on an engine main body side so as to cover the electromagnetic brake 8. The rotation regulation mechanism 30 regulates relative rotation of the electromagnetic brake 8 relative to the cover 7 about the camshaft 2.

As will be described later, the electromagnetic brake 8 attracts the surface 9*a* of the drum 9. Accordingly, rotation of the drum 9 about the camshaft 2 is delayed. As a result, the moving member 11 moves axially to change the phase of the camshaft 2 relative to those of the rotary crank body 18 and the crankshaft 1. In other words, when rotation of the drum 9 is delayed, the moving member 11 changes the angular orientation between the drum 9 and the rotary crank body 18 against the biasing force of the coil torsion spring 10. More specifically, the cylindrical splined shaft 13 is fixed to an end of the camshaft 2 via a fixing bolt 3 and a positioning pin 21. Thus, the splined shaft 13 rotates together with the camshaft 2.

Figure 3:
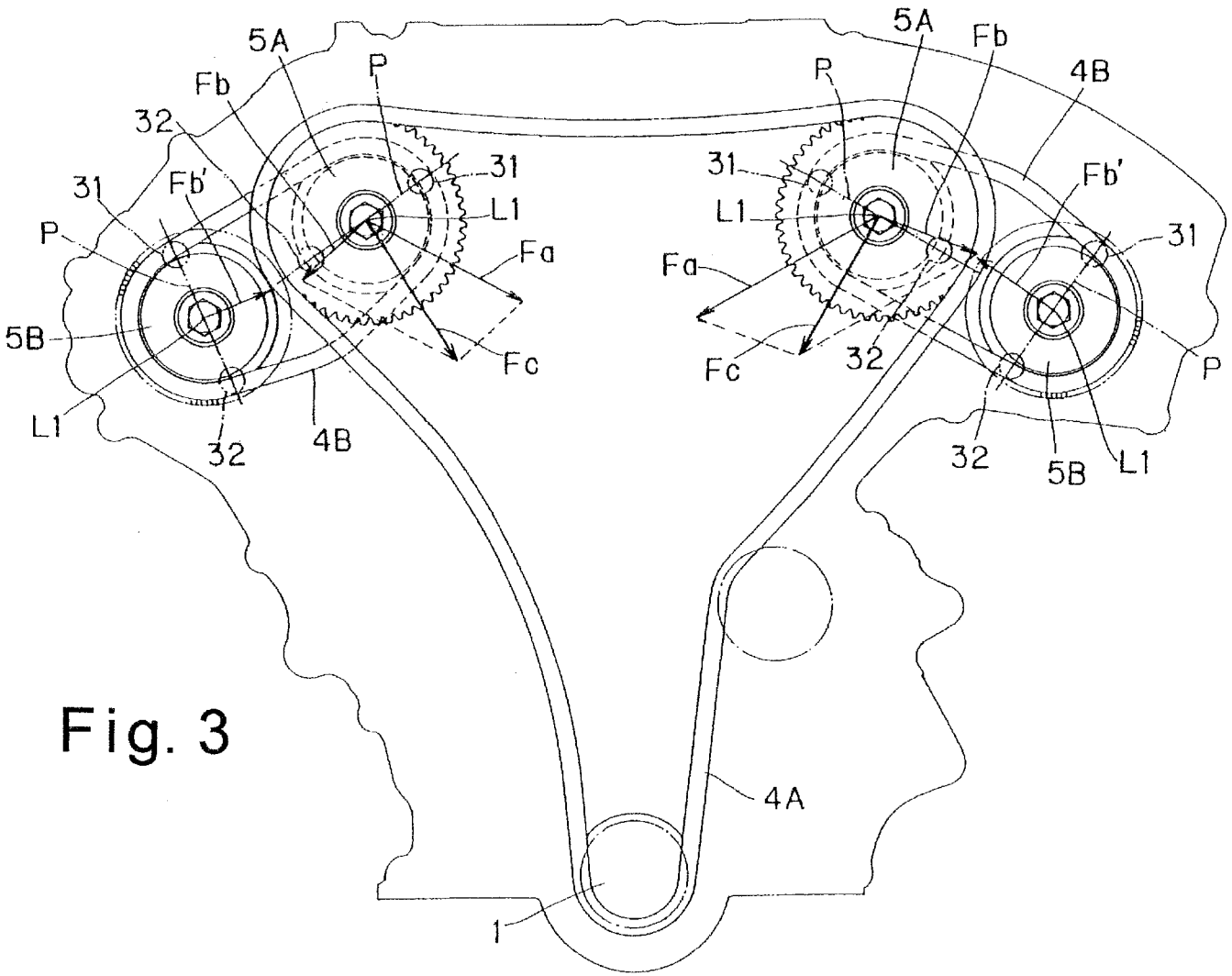
FIG. 3 is a front elevational view of a V-type internal combustion engine in which the variable valve timing apparatus illustrated in FIGS. 1 and 2 is utilized.
Figure 4:
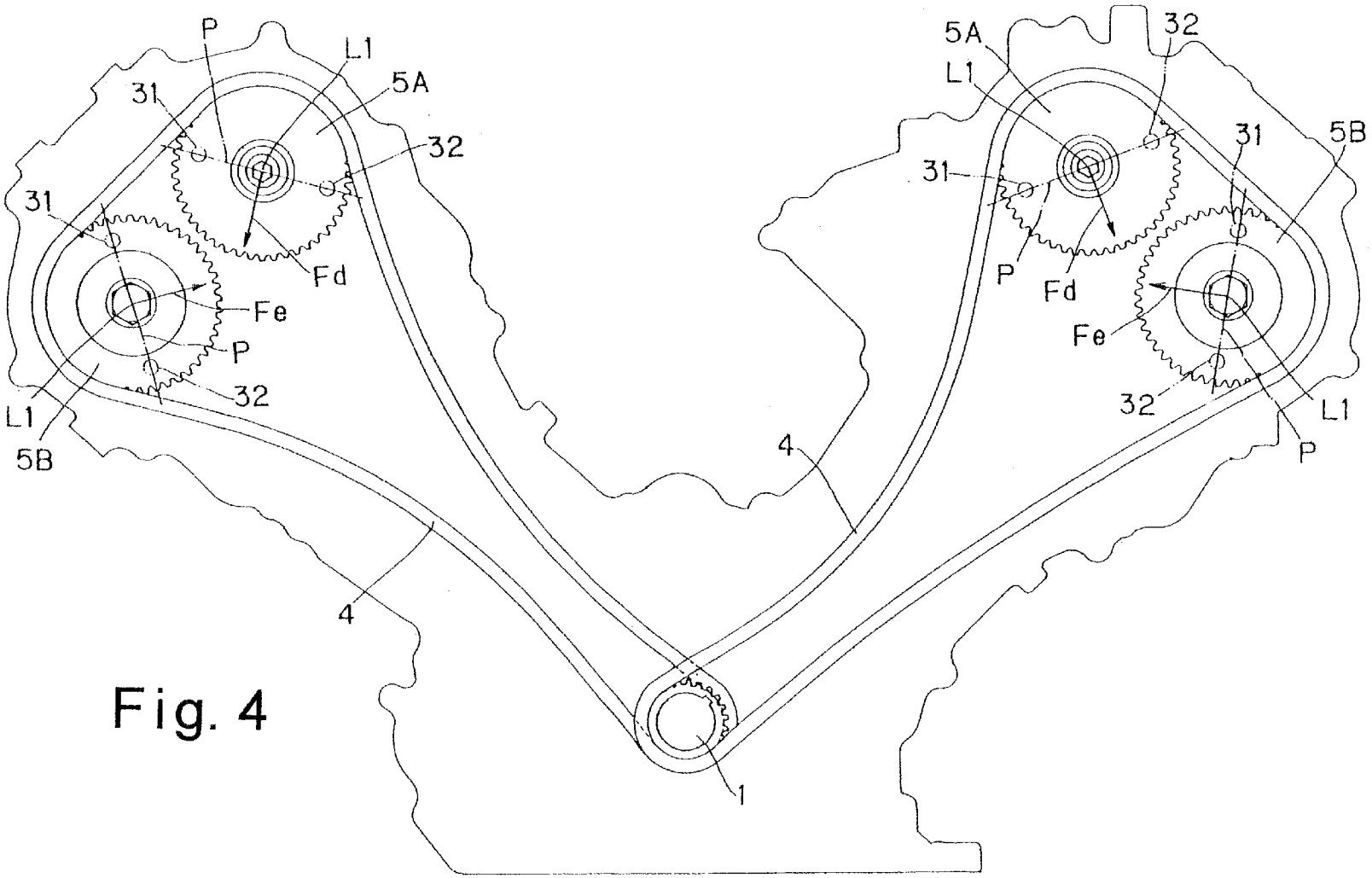
FIG. 4 is a front elevational view of another V-type internal combustion engine in which the variable valve timing apparatus illustrated in FIGS. 1 and 2 is utilized.

In the embodiments shown in FIGS. 3 and 4, two examples of timing arrangements are illustrated to explain the present invention. For instance, as shown in FIG. 3, a V-type internal combustion engine has a main drive member 4A that is wound onto the crankshaft 1 and a pair of driven members or intake sprockets 5A that are disposed on inner sides of a V bank. Two sub drive members 4B are wound onto the driven members or intake sprockets 5A and two additional driven members or exhaust sprockets 5B that are adjacent each other in each bank. Alternatively, as shown in FIG. 4, a single drive member 4 can be wound onto the intake sprockets 5A, the exhaust sprockets 5B, and the crankshaft 1 in each bank. While the drive member 4 is illustrated as a timing chain that engages the sprockets 5A and 5B, the drive member 4 can be either a timing chain or a timing belt. If the drive member 4 is a timing belt, then the driven members 5A and 5B are pulleys, instead of sprockets. In any event, the V-type internal combustion engines shown in FIGS. 3 and 4 each utilizes four variable valve timing apparatuses in accordance with the present invention.

Referring again to FIG. 1, the rotary crank body 18 basically includes a sprocket or driven member 5, a spring case 12, a spring cover 22 and a plurality of bolts 17. The timing chain or drive member 4 engages the sprocket 5 and other the sprockets to transmit rotational torque from the crankshaft 1 to the camshaft 2. The spring cover 22 covers a portion of an outer periphery of the coil torsion spring 10. The spring case 12 is fixedly coupled to a first end of the coil torsion spring 10. These members 5, 12, and 22 are fixedly coupled together by jointly tightening the bolts 17. The rotary crank body 18 is rotatably coupled to an outer periphery of the splined shaft 13 so as to be relatively rotatable.

An inner peripheral surface of the moving member 11 and the outer peripheral surface of the splined shaft 13 have helical splines that are meshed together to form a helical or spiral spline arrangement 27. An outer peripheral surface of the moving member 11 and an inner peripheral surface of the spring case 12 have helical splines that are meshed together to form a helical or spiral spline arrangement 28. Therefore, as the moving member 11 moves in the direction of the axis of the camshaft 2 (left-right direction in FIG. 1), the splined shaft 13 and the spring case 12 rotate relative to each other. Accordingly, the phase of the camshaft 2 changes relative to that of the rotary crank body 18. The drum 9 is coupled to the outer periphery of the splined shaft 13 via bearings 14 so as to be relatively rotatable. The inner periphery of the drum 9 has a stopping ring 23 that abuts on one of the axial surfaces of bearings 14. The inner peripheral surface of the drum 9 and the outer peripheral surface of the moving member 11 each has a spiral square thread or spline that meshes with the other to form a square thread arrangement 29 or a spiral spline arrangement. Accordingly, as the drum 9 rotates relative to the moving member 11, the moving member 11 moves axially relative to the drum 9.

A disk-shaped flange 9*b* that extends in a radially outward direction is formed on an axial end of the drum 9. The flange 9*b* has a pin 24 that receives one end of the coil torsion spring 10 to fix that end of the torsion spring 10 to the drum 9. The flange 9*b* also has a surface 9*a* that opposes a surface 8*a* of the electromagnetic brake 8.

The electromagnetic brake 8 is a substantially annular member that includes an electromagnetic coil 25 and a housing 26 that houses the electromagnetic coil 25. The electromagnetic coil 25 is electrified and controlled in response to an engine operational state signal that is sent from a controller (not shown in the FIG.). A thin plate-shaped friction member 8*b* is provided on the axially inner surface 8*a* that is opposite and slideably adjacent to the surface 9*a* of the drum 9.

The rotation regulation mechanism 30 includes a first protrusion 31 and a second protrusion 32, and a first concavity 33 and a second concavity 34. The first and second protrusions 31 and 32 are fixed to an axial end wall portion of the housing 26 of the electromagnetic brake 8. The first protrusion 31 and the second protrusion 32 are cylindrical and extend axially outward from the end wall portion of the housing 26. The first and the second concavities 33 and 34 are concavely provided in an inner wall portion of the cover 7. Preferably, the first and the second concavities 33 and 34 are substantially circular holes to which the first protrusion 31 and the second protrusion 32 loosely coupled therein, respectively. In other words, the first and second concavities 33 and 34 are designed so as to have a larger diameter and a longer dimension than those of the protrusions 31 and 32, such that slight displacement of the electromagnetic brake 8 relative to the cover 7 can be accommodated in both the axial direction and the circumferential direction.

In view of possible assembling errors, the axial dimension of a space between the drum 9 and the cover 7, in which the electromagnetic brake 8 is housed, is sized so as to be slightly greater than the axial dimension of the electromagnetic brake 8, such that a small gap D1 is formed in between the electromagnetic brake 8 and the cover 7, in view of possible assembling errors.

Figure 6:
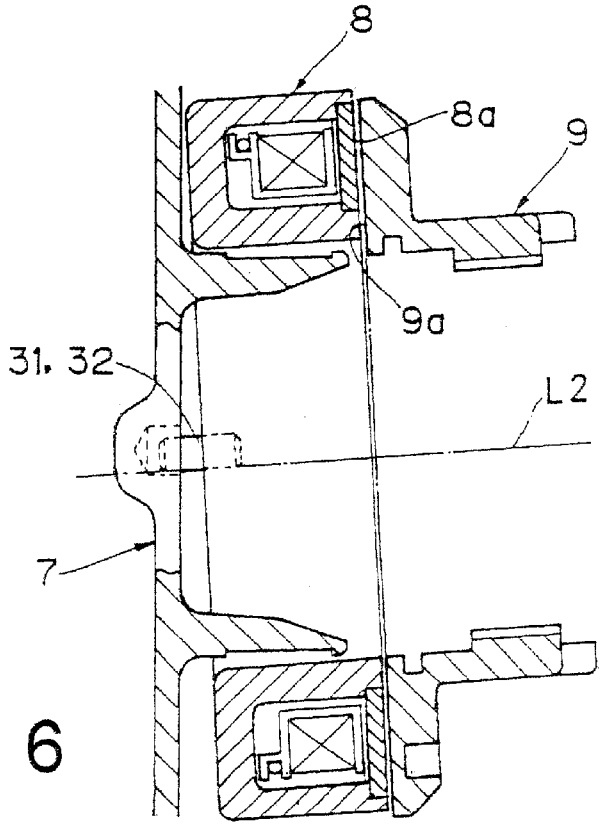
FIG. 6 is an explanatory cross sectional view showing the electromagnetic brake being inclined to uniformly face and contact the drum in accordance with the present embodiment since the protrusions lie on a base line that is substantially perpendicular to the direction (the vertical upward direction) of the total tensions apply to the drum via the timing belt or timing chain.

In the rotation regulation mechanism 30, the first and second protrusions 31 and 32 lying on a base line P passing substantially through a center (axis of rotation) of the drum 9. The base line P is set so as to be substantially perpendicular to a direction of a tension or a resultant force of tension applied from the chain or belt 4 to the sprocket or pulley 5. By virtue of the rotation regulation mechanism 30, the relative rotation of the electromagnetic brake 8 relative to the cover 7 is regulated. At the same time, inclination of the electromagnetic brake 8 relative to the cover 7 about the base line P can be adequately tolerated. Therefore, even when the drum 9 becomes inclined relative to the base line P due to the aforementioned tension of a resultant force of tension, the electromagnetic brake 8 also becomes inclined as seen in FIG. 6, compensating for the inclination of the drum 9. Therefore, partial contact between the opposing surfaces 8*a* and 9*a* of the drum 9 and the electromagnetic brake 8, respectively, can be effectively prevented.

In the cover 7, a guide 7*b* is formed as a cup-shaped protrusion. The guide 7*b* opposes the inner peripheral surface of the electromagnetic brake 8 with an adequate gap therebetween. In other words, the cover 7 covers the electromagnetic brake 8 from three directions in order to regulate excessive displacement of the electromagnetic brake 8.

The above-described rotary crank body 18, the moving member 11 and the electromagnetic brake 8 are disposed coaxially about the center axis L1 of the camshaft 2 in the normal state. Also, several lubricant supply grooves 36, 37 and 38 are formed on splined shaft 13 in order to supply lubricant to various bearing portions.

In the embodiments shown in FIGS. 3 and 4, a base line P is defined so as to lie along a predetermined diameter of the electromagnetic brake 8 (or the camshaft 2). The base line P connects the first protrusion 31 and the second protrusion 32 when viewed along the axial direction such that the base line P passes through the center (axis of rotation) of the drum 9. In other words, the first and second protrusions 31 and 32 are disposed opposite each other (180° apart) with the center axis L1 of the camshaft 2 therebetween. Similarly, the concavities 33 and 34 are also disposed opposite each other with the center axis L1 therebetween.

Due to this structure, in an initial state (non-operating state) in which the electromagnetic brake 8 is not electrified, the drum 9 is kept at the initial position due to the biasing force of the coil torsion spring 10. The initial position of the drum 9 is the position most rotated in the direction of rotation of the camshaft 2 relative to the rotary crank body 18. In this state, the rotary crank body 18, the moving member 11, the drum 9 and the camshaft 2 rotate in sync.

In this initial state, as the controller electrifies the electromagnetic brake 8, the magnetic force that is generated between the electromagnetic brake 8 and the drum 9 makes the electromagnetic brake 8 attract the axial side surface 9*a* of the drum 9. In this manner, the electromagnetic brake 8 is attracted and biased toward the drum 9. Frictional force is generated in between the opposing surfaces 8*a* and 9*a* of the electromagnetic brake 8 and the drum 9. Then, rotation of the drum 9 about the camshaft 2 is adequately delayed due to the spring force of the coil torsion spring 10. Accordingly, the drum 9 relatively rotates with respect to the moving member 11, which makes the moving member 11 move axially via the square thread arrangement 29. The spring case 12 and the splined shaft 13 relatively rotate via the helical or spiral spline arrangement 27 and 28. As a result, the phase of the camshaft 2 changes relative to that of the rotary crank body 18. Accordingly, the valve timing of the intake and/or exhaust valves is adequately changed.

By controlling the attraction force of the electromagnetic brake 8, the attraction force and the biasing force of the coil torsion spring 10 can be balanced. In this way, the amount of delay of the drum 9 can be freely controlled within a predetermined control range. Accordingly, the valve timing can be controlled continuously.

Tension force is applied from the chain 4 to the sprocket 5. Although the magnitude of each tension force varies depending on the variation of the driving torque or burning torque of the camshaft 2 during the engine operation, its direction is mostly constant. In other words, direction of each tension force substantially equals to a direction from the center of the meshed portion between the chain 4 and the sprocket 5 toward the center of the sprocket 5.

For instance, as shown in FIG. 3, in the case of a V-shaped internal combustion engine, the main chain 4A is wound onto the crankshaft 1 and a pair of intake sprockets 5A that are disposed on inner sides of a V bank, while a sub chains 4B are wound onto the intake sprockets 5A and exhaust sprockets 5B that are adjacent each other in each bank. The intake sprockets 5A receive tension force Fa from the main chain 4A, and tension force Fb from the sub chain 4B, which create a resultant force Fc. On the other hand, the exhaust side sprocket 5B receives tension force Fb' from the sub chain 4B.

Alternatively, as shown in FIG. 4, a single chain 4 can be wound onto the intake sprockets 5A, the exhaust sprockets 5B, and the crankshaft 1 in each bank. In this case, tension Fd and Fe are applied from the chain 4 to the sprockets 5A and 5B, respectively.

Due to the total tension (tension or resultant of tensions) from the chain 4 to the sprocket 5, the center axis L2 of the drum 9 that engages the sprocket 5 via the moving member 11 sometimes becomes inclined relative to the center axis L1 of the camshaft 2.

Figure 5:
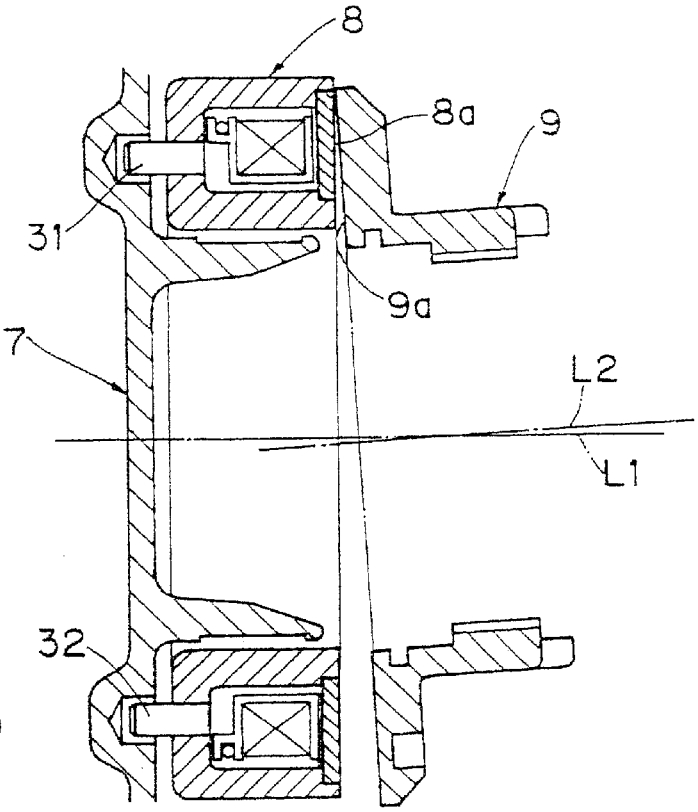
FIG. 5 is an explanatory cross sectional view showing the inclination of the drum relative to the electromagnetic brake when the protrusions lie on a base line that is parallel to the direction (the vertical upward direction) of the total tensions apply to the drum via the timing belt or timing chain.

Now, as seen in a comparative example in FIG. 5, when the base line that connects the protrusions 31 and 32 is set in parallel with the direction in which the aforementioned total tensions apply (the vertical upward direction in FIG. 5), the electromagnetic brake 8 cannot become inclined to compensate for the inclination of the drum 9 in a preferable manner. As a result, the center axis L2 of the drum 9 and the center axis (L1) of the electromagnetic brake 8 become offset from each other as seen in FIG. 5. Accordingly, the opposing surfaces 8*a* and 9*a* of the electromagnetic brake 8 and the drum 9 only partially contact each other. As a result, the frictional force that is applied to the sliding surfaces 8*a* and 9*a* becomes unstable. Therefore, desired phase adjustment cannot be obtained.

In this embodiment, as seen in FIGS. 3 and 4, the base lines P that connect the first protrusion 31 and the second protrusion 32 are set so as to be substantially perpendicular to the direction of total tensions (Fc and Fb' in FIG. 3 and Fd and Fe in FIG. 4) applied from the rotation torque transmission the chain 4 to the sprockets 5. In this way, as shown in FIG. 6, even if the center axis L2 of the drum 9 becomes inclined due to the chain tension as described above, the electromagnetic brake 8 can also become inclined about the base line P, compensating for the inclination of the center axis L2. Accordingly, the opposing surfaces 8*a* and 9*a* of the electromagnetic brake 8 and the drum 9 can uniformly face and contact each other. As a result, the sliding surfaces 8*a* and 9*a* do not partially contact each other. The friction torque generated in the sliding surfaces 8*a* and 9*a* becomes stable. Therefore, desired valve timing adjustment can be obtained.

Figure 7:
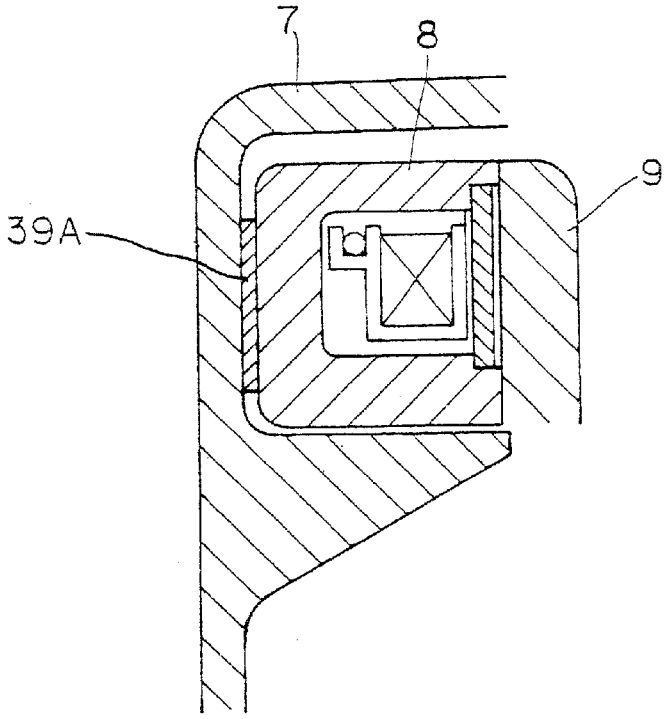
FIG. 7 is a partial cross sectional view of a selected portion of a first example of the elastic member in accordance with the present invention.
Figure 8:
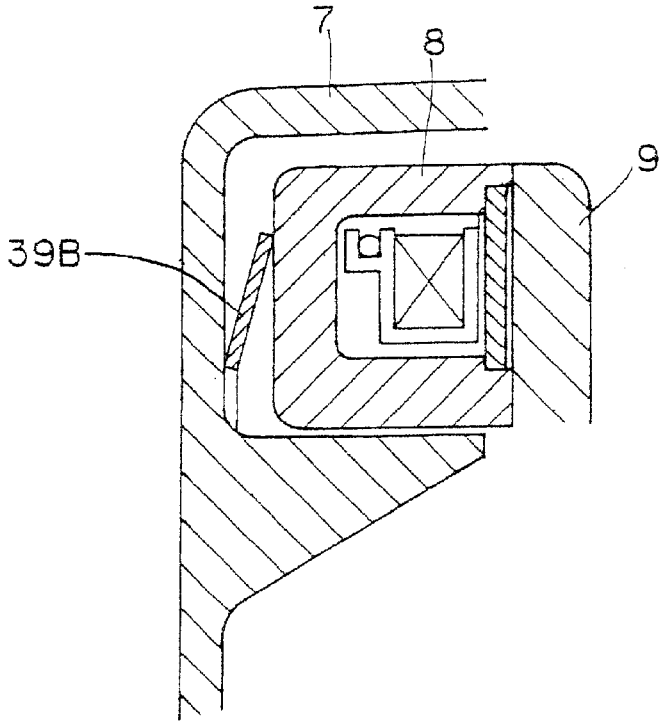
FIG. 8 is a partial cross sectional view of a selected portion of a second example of the elastic member in accordance with the present invention.
Figure 9:
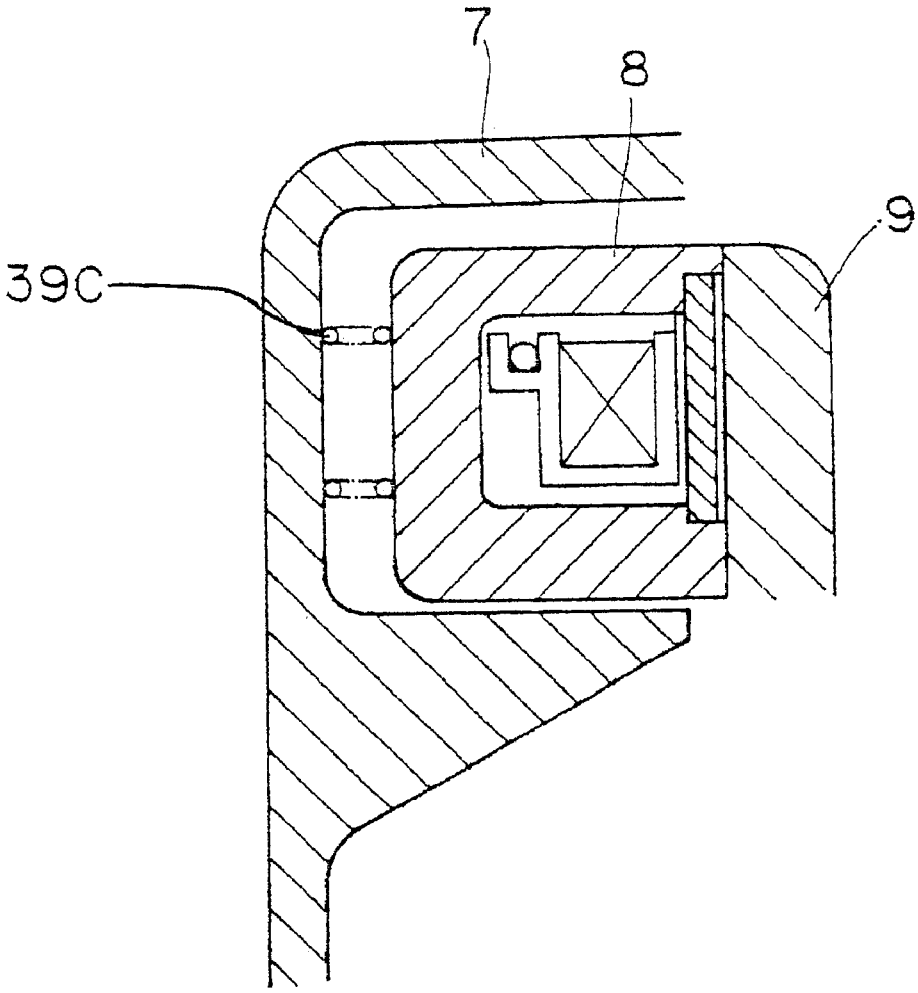
FIG. 9 is a partial cross sectional view of a selected portion of a third example of the elastic member in accordance with the present invention.

More preferably, as seen in FIGS. 7–9, an elastic member 39A, 39B or 39C is disposed in between the axial opposing surfaces of the outer wall portions of the electromagnetic brake 8 and the inner wall of the cover 7. The elastic member 39A, 39B or 39C urges the electromagnetic brake 8 axially toward the drum 9. More specifically, the elastic member 39A can be a rubber element as shown in FIG. 7, or a wave spring (plate spring) 39B as shown in FIG. 8, or a plurality of coil springs 39C as shown in FIG. 9. In the structure shown in FIGS. 6 and 7, in order to avoid conflict with the protrusions 31 and 32, adequate cut out portions (omitted in FIG.) are created for the annular elastic members 39A and 39B, or a plurality of elastic members 39A are placed intermittently around the periphery.

By providing one or more elastic members 39A, 39B or 39C in this manner, the surface 8*a* of the electromagnetic brake 8 and the surface 9*a* of the drum 9 are kept so as to always uniformly contact each other even in the initial state, in which electric power is not supplied to the electromagnetic brake 8. Therefore, due to the axial gap D1 secured between the electromagnetic brake 8 and the cover 7, inadvertent axial vibrations and rattling of the electromagnetic brake 8 can be restrained. Also, even if rattling occurs, it is reduced quickly by the damping effect of the elastic member 39A, 39B or 39C. Therefore, vibrations and noises that result from such rattling can be certainly reduced.

In other words, in order to reduce vibrations of the electromagnetic brake 8 securely, the urging force of the elastic member 39A, 39B or 39C is set in advance so as to be greater than a predetermined axial vibration input that is applied to the electromagnetic brake 8.

However, if the urging force of the elastic member 39A, 39B or 39C is set excessively great, then the drum 9 can rotate from the initial phase inadvertently due to the biasing force of the coil torsion spring 10 even in the initial state, in which the electromagnetic brake 8 is not electrified. Therefore, in such initial state, the biasing force of the coil torsion spring 10 and urging force of elastic member 39A, 39B or 39C should be set adequately such that the drum 9 is maintained at a position most rotated in the rotational direction of the camshaft 2 relative to the rotary crank body 18.

Therefore, preferably, by setting the urging force of the elastic member 39A, 39B or 39C sufficiently great, but not greater than the biasing force of the coil torsion spring 10, the attraction force can be sufficiently limited. In other words, the electric power to be consumed of the electromagnetic brake 8 that is necessary for phase changing can be sufficiently limited. In this manner, the electromagnetic brake 8 requires less electric power and also can be reduced in size. In this case, at the time of shifting from the electrified state to the electrification stopping state, the drum 9 can quickly return to the initial phase by the biasing force of the coil torsion spring 10 that exceeds the urging force of the elastic member 39A, 39B or 39C.

Although the shapes of the aforementioned protrusions 31 and 32 and the concavities 33 and 34 are cylindrical and circular holes in the aforementioned embodiment, other shapes such as key and key groove and shapes having width across flats can also be utilized.

Additionally, although the chain 4 and sprockets 5 are utilized in the rotational torque transmission path of rotational torque of the crankshaft 1 in the aforementioned embodiment, this structure can be substituted with other structures such as one that has timing belt and pulley, or one in which a gear is partially utilized.

Furthermore, with regard to the layout of the chain 4, other multi-level structures and one-level structures can be utilized, other than the ones shown in FIGS. 3 and 4.

Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2000-289976. The entire disclosure of Japanese Patent Application No. 2000-289976 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. By A variable valve timing apparatus for an internal combustion engine, comprising:

a rotary crank body adapted to be coaxially coupled with a camshaft, and to be operatively rotated by a crankshaft;

a moving member operatively coupling said rotary crank body to the camshaft along a rotational torque transmission path that transmits torque from said rotary crank body to the camshaft;

a drum operatively coupled to said moving member to move said moving member in an axial direction relative to said drum upon relative rotational movement between said drum and said moving member;

a biasing member elastically coupling said drum to said rotary crank body to apply a biasing force on said drum in a direction of rotation of the camshaft relative to said rotary crank body;

an electromagnetic brake disposed opposite an axial side surface of said drum to attract said axial side surface of said drum towards said electromagnetic brake with a magnetic force upon energizing said electromagnetic brake to delay rotation of said drum about the camshaft and to change a phase of the camshaft relative to a phase of said rotary crank body due to an axial movement of said moving member;

a cover fixed to an engine main body side of said electromagnetic brake to cover said electromagnetic brake; and a rotation regulation mechanism operatively coupled between a wall portion of said electromagnetic brake and a wall portion of said cover to regulate relative rotation of said electromagnetic brake about the camshaft relative to said cover, said rotation regulation mechanism including first and second protrusions provided on one of said wall portions and first and second concavities provided on the other of said wall portions, said wall portions being opposing each other with said first and second protrusions being coupled to said first and second concavities, respectively, said first and second protrusions lying on a base line passing substantially through a center of said drum.

2. The variable valve timing apparatus as set forth in claim 1, wherein said rotary crank body includes a driven member engaged by a drive member that is wound onto of said driven member to receive a rotational torque from the crankshaft; and said base line is arranged substantially perpendicular to a direction of a resultant force of tension applied from said drive member to said driven member.

3. The variable valve timing apparatus as set forth in claim 2, further comprising an elastic member arranged between said wall portion of said electromagnetic brake and said wall portion of said cover to urge said electromagnetic brake toward said drum.

4. The variable valve timing apparatus as set forth in claim 3, wherein said elastic member applies an urging force that at least exceed a predetermined axial vibration input applied to said electromagnetic brake.

5. The variable valve timing apparatus as set forth in claim 4, wherein said biasing force of said biasing member and said urging force of said elastic member are set such that said drum is maintained at a position most rotated in a direction of rotation of the camshaft relative to said rotary crank body when said electromagnetic brake is in an initial state in which said electromagnetic brake is not electrified.

6. The variable valve timing apparatus as set forth in claim 1, further comprising an elastic member arranged between said wall portion of said electromagnetic brake and said wall portion of said cover to urge said electromagnetic brake toward said drum.

7. The variable valve timing apparatus as set forth in claim 6, wherein said elastic member applies an urging force that at least exceed a predetermined axial vibration input applied to said electromagnetic brake.

8. The variable valve timing apparatus as set forth in claim 6, wherein said biasing force of said biasing member and said urging force of said elastic member are set such that said drum is maintained at a position most rotated in a direction of rotation of the camshaft relative to said rotary crank body when said electromagnetic brake is in an initial state in which said electromagnetic brake is not electrified.

9. The variable valve timing apparatus as set forth in claim 1, wherein said biasing member is a torsion spring having a first end coupled to said drum and a second end coupled to said rotary crank body.

10. The variable valve timing apparatus as set forth in claim 1, wherein said rotary crank body is movably coupled to said moving member for relative axial movement by a first helical spline arrangement formed therebetween.

11. The variable valve timing apparatus as set forth in claim 10, wherein said moving member is movably coupled to said drum for relative axial movement by a thread arrangement formed therebetween.

12. The variable valve timing apparatus as set forth in claim 11, further comprising a splined shaft adapted to be coaxially coupled said rotary crank body with the camshaft, said splined shaft being coupled to said moving member for relative axial movement by a second helical spline arrangement formed therebetween.

13. The variable valve timing apparatus as set forth in claim 12, wherein said drum is rotationally supported on said splined shaft.

14. The variable valve timing apparatus as set forth in claim 12, wherein said splined shaft has a center bore that is adapted to receive a fastener to secure said splined shaft to the camshaft.

15. The variable valve timing apparatus as set forth in claim 12, wherein said biasing member is a torsion spring having a first end coupled to said drum to and a second end coupled to said rotary crank body.

16. A variable valve timing apparatus for an internal combustion engine, comprising:

rotary crank means for coaxially coupling with a camshaft, and for being operatively rotated by a crankshaft;

moving means for operatively coupling said rotary crank means to the camshaft along a rotational torque transmission path that transmits torque from said rotary crank means to the camshaft;

drum means for moving said moving means in an axial direction relative to said drum means upon relative rotational movement between said drum means and said moving means;

biasing means for elastically coupling said drum means to said rotary crank means to bias said drum means in a direction of rotation of the camshaft relative to said rotary crank means;

electromagnetic brake means, disposed opposite an axial side surface of said drum means, for attracting said axial side surface of said drum means towards said electromagnetic brake means with a magnetic force upon energizing said electromagnetic brake means to delay rotation of said drum means about the camshaft and to change a phase of the camshaft relative to a phase of said rotary crank means due to an axial movement of said moving means;

cover means for covering said electromagnetic brake means; and rotation regulation means for regulating relative rotation of said electromagnetic brake means about the camshaft relative to said cover means, said rotation regulation means being disposed between said electromagnetic brake means and said cover means to regulate relative rotation of said electromagnetic brake means about the camshaft relative to said cover means.

17. The variable valve timing apparatus as set forth in claim 16, wherein said rotation regulation means including first and second protrusions and first and second concavities, said first and second protrusions being coupled to said first and second concavities, respectively, said first and second protrusions lying on a base line passing substantially through a center of said drum means.

18. The variable valve timing apparatus as set forth in claim 17, wherein said rotary crank means includes a driven member engaged by a drive member that is wound onto of said driven member to receive a rotational torque from the crankshaft; and said base line is arranged substantially perpendicular to a direction of a resultant force of tension applied from said drive member to said driven member.

19. The variable valve timing apparatus as set forth in claim 18, further comprising elastic means for urging said electromagnetic brake toward said drum.

20. The variable valve timing apparatus as set forth in claim 16, further comprising elastic means for urging said electromagnetic brake toward said drum.

* * * * *